US009107455B2

(12) United States Patent
Fournier et al.

(10) Patent No.: US 9,107,455 B2
(45) **Date of Patent: *Aug. 18, 2015**

(54) CIGARETTE FILTER

(75) Inventors: Jay A Fournier, Richmond, VA (US); Zhaohua Luan, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1434 days.

This patent is subject to a terminal disclaimer.

(21) Appl. No.: 10/989,416

(22) Filed: Nov. 17, 2004

(65) Prior Publication Data

US 2005/0133052 A1 Jun. 23, 2005

Related U.S. Application Data

(60) Provisional application No. 60/523,671, filed on Nov. 21, 2003.

(51) Int. Cl.
*A24D 3/16* (2006.01)
*A24D 3/14* (2006.01)

(52) U.S. Cl.
CPC . *A24D 3/166* (2013.01); *A24D 3/14* (2013.01)

(58) Field of Classification Search
USPC ..... 131/202, 207, 331
See application file for complete search history.

(56) References Cited

U.S. PATENT DOCUMENTS 2,739,598 A * 3/1956 Eirich ..... 131/334
2,834,354 A 5/1958 Rosenberg
2,839,065 A * 6/1958 Milton ..... 131/331
2,956,329 A 10/1960 Touey
2,968,306 A 1/1961 Touey et al.
3,353,544 A * 11/1967 Fordyce et al. ..... 131/342
3,989,650 A 11/1976 Lange et al.
4,033,361 A 7/1977 Horsewell et al.
4,138,363 A * 2/1979 Hertzenberg et al. ..... 252/179
4,372,328 A 2/1983 Kausch et al.
4,454,056 A * 6/1984 Kittelmann et al. ..... 510/466
5,692,525 A 12/1997 Counts et al.
5,727,573 A * 3/1998 Meier et al. ..... 131/341
5,927,287 A 7/1999 Matsumura et al.

(Continued)

FOREIGN PATENT DOCUMENTS

WO WO 2004054708 A2 * 7/2004

OTHER PUBLICATIONS

Chang, A., Chuang, S., Gray, M., Soong, Y., "In-Situ Infrared Study of CO2 Adsorption on SBA-15 Grafted with y-(Aminopropyl)triethoxysilane", Energy and Fuels, v.17, (2003), pp. 468-473).*

(Continued)

*Primary Examiner* — Jason L Lazorcik
(74) *Attorney, Agent, or Firm* — Buchanan, Ingersoll & Rooney PC

(57) ABSTRACT

A cigarette filter containing a mesoporous silicate molecular sieve modified by an aminoalkylsilyl group. The modified molecular sieve reacts with selected components of cigarette smoke to remove or reduce the concentration of the components without adversely affecting desirable flavor constituents of the smoke. The modified molecular sieve preferably is SBA-15, MCM-41 or MCM-48 modified by 3-aminopropylsilyl groups. The modified molecular sieve may be incorporated into the filter by inclusion into a space therein or into one or more of the filter elements or into a fibrous component.

42 Claims, 3 Drawing Sheets

(56) References Cited

U.S. PATENT DOCUMENTS

| | | | | |
|---|---|---|---|---|
| 6,119,699 | A | 9/2000 | Sung | |
| 6,209,547 | B1 | 4/2001 | Koller et al. | |
| 6,595,218 | B1 | 7/2003 | Koller et al. | |
| 6,630,170 | B2 | 10/2003 | Balkus, Jr. et al. | |
| 2005/0133048 | A1* | 6/2005 | Fournier et al. | 131/202 |

OTHER PUBLICATIONS

Hoffmann, F., Cornelius, M., Morell, J., Froba, M., "Silica-Based Mesoporous Organic-Inorganic Hybrid Materials", Angew. Chem. Int. Ed., v.45, (2006), pp. 3216-3251.*

Gunjishima, I., Akashi, T., Goto, T., "Characterization of Directionally Solidified B4C-TiB2 Composites Prepared by a Floating Zone Method", Materials Transactions, v.43, n. 4, (2002), pp. 712-720.*

Jaroniec et al. (J.Phys. Chem. B 1998, 102, 5503-5510).*

Han et. al. (J. Am. Chem. Soc. 1999,121, 9897-9898).*

Xu (Xu, Yi., Zhu, J.H., Ma, L.L., Ji, A., Wei, Y.L., Shang, X.Y., "Removing nitrosamines from mainstream smoke of cigarettes by zeolites", Microporous and Mesoporous Materials 60 (2003) 125-138).*

MacQuarrie, Duncan J. et al., "Aminopropylated MCMs as base catalysts: a comparison with aminopropylated silica", Chem. Commun., 1997, pp. 1781-1782, Received in Cambridge, UK, Jun. 16, 1977, 7/04156J.

* cited by examiner

CIGARETTE FILTER

This application claims priority under 35 U.S.C. §119 to U.S. Provisional Application No. 60/523,671 entitled CIGARETTE FILTER, filed Nov. 21, 2003, the entire content of which is hereby incorporated by reference.

BACKGROUND

A wide variety of materials have been suggested as additives in cigarette filters to selectively remove components of cigarette smoke. These materials include molecular sieves and particularly zeolite-type molecular sieves.

There is decided interest in a cigarette filter which can be tailored to selectively remove or reduce the concentration of various constituents of cigarette smoke while retaining desirable flavor components.

SUMMARY

A filter cigarette is provided which contains a mesoporous silicate molecular sieve modified with aminoalkylsilyl groups. Also provided is a substantially cylindrical cigarette filter containing a mesoporous silicate molecular sieve modified with aminoalkylsilyl groups, a method of manufacturing the aforementioned filter cigarette, and a method of smoking a filter cigarette containing a mesoporous silicate molecular sieve modified with aminoalkylsilyl groups.

In one embodiment, a filter cigarette is prepared containing tobacco and a filter having a component comprising a mesoporous silicate molecular sieve modified with aminoalkylsilyl groups. The cigarette may be a traditional or non-traditional cigarette.

A further embodiment provides a method of manufacturing a filter cigarette which includes joining a filter containing a mesoporous silicate molecular sieve modified with aminoalkylsilyl groups to a tobacco rod with tipping paper.

In yet another embodiment, a cigarette filter is prepared containing a mesoporous silicate molecular sieve modified with aminoalkylsilyl groups. The modified molecular sieve may be incorporated in a filter component selected from filter paper, shaped paper insert, a plug, a space or a free-flow sleeve.

Another embodiment provides a method of smoking a filter cigarette. The cigarette is lit to form cigarette smoke which is drawn through the filter wherein the filter contains a mesoporous silicate molecular sieve modified with aminoalkylsilyl groups. The modified molecular sieve reacts with at least one constituent of the smoke to remove or reduce the concentration of the constituent without adversely affecting desirable flavor components in the cigarette smoke.

DETAILED DESCRIPTION OF PREFERRED EMBODIMENTS

Figure 1:
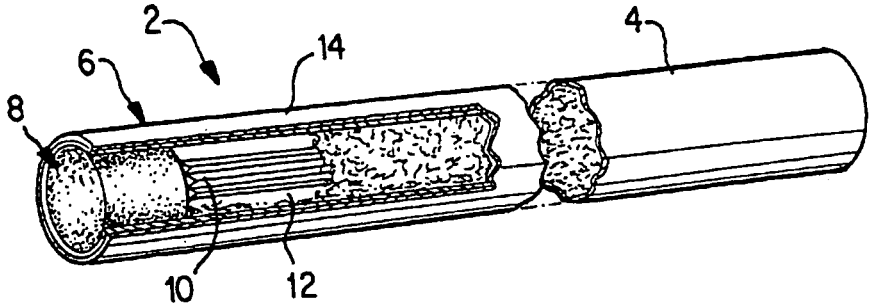
FIG. 1 is a perspective partially exploded view of a cigarette manufactured according to one embodiment wherein folded paper containing a chemically modified molecular sieve is inserted into a hollow portion of a tubular filter element of the cigarette.

Filter cigarettes and filters are provided which contain a sorbent comprising a modified mesoporous silicate molecular sieve. At least some of the accessible hydroxyl groups associated with the tetrahedral framework of the molecular sieve are reacted with aminoalkyltrialkoxysilane reagents to provide the sieve with aminoalkylsilyl groups. These groups react with selected constituents present in mainstream cigarette smoke to remove or reduce the constituents.

The term "sorption" denotes filtration by adsorption and/or absorption and is intended to encompass interactions on the outer surface of a sorbent, as well as interactions within the pores and channels thereof. A "sorbent" is a substance that has the ability to condense or hold molecules of other substances on its surface and/or the ability to take up other substances, i.e., through penetration of the other substances into its inner structure or into its pores. The term "sorbent" as used herein refers to either an adsorbent, and absorbent, or a substance that can function as both an adsorbent and an absorbent.

The term "remove" as used herein refers to adsorption and/or absorption of at least some portion of a selected component of mainstream tobacco smoke.

The term "mainstream smoke" includes the mixture of gases which passes down a tobacco column and issues through the filter end, i.e., the amount of smoke issuing or drawn from the mouth end of a smoking article such as a cigarette during smoking. The mainstream smoke contains air that is drawn in through both the lit region of the smoking article, as well as through the paper wrapper.

The terms "aminoalkylsilyl" and "aminoalkyltrialkoxysilanes" are intended to include reagents where the alkyl group contains about 1 to 5 carbon atoms. These include reagents derived from alkylene polyamines such as N-[3-(trimethoxysilyl)propyl]-ethylenediamine and N'-[3-(trimethoxysilyl) propyl]-diethylenetriamine.

The term "mesoporous" generally refers to molecular sieve materials having pore sizes ranging from about 15 Å to about 300 Å.

Microporous and mesoporous molecular sieve materials admit molecules below a certain critical size into their extensive internal space, which makes them of considerable interest as heterogeneous catalysts and sorbents. Zeolites are by far the best-known class of molecular sieves. In comparison with microporous zeolites, mesoporous molecular sieve materials, developed in the past decade such as M41S and SBA-15, possess uniform size and shape of the pores over micrometer length scales. Their high thermal stability as well as the prospect of "tuning" the pore aperture, either by selecting a suitable template for their synthesis or by grafting various organic/inorganic functional groups via post-synthesis procedures, makes these materials potentially useful for many adsorption and catalytic applications. The ion-exchange, catalytic, and sorptive properties of aluminosilicate molecular sieves originate from acid sites which arise from the presence of accessible hydroxyl groups associated with tetrahedral framework aluminum in a silica matrix.

The accessible hydroxyl groups of mesoporous silicate molecular sieves can be reacted with aminoalkyltrialkoxy silane reagents to provide the molecular sieves with aminoalkylsilyl groups such as 3-aminopropylsilyl groups. This chemical modification provides modified mesoporous silicate molecular sieves with the capability of selectively removing constituents of cigarette smoke by reaction of the constituents with the aminoalkylsilyl groups. It is believed that the primary amine group at the terminal (exposed or free) end of the aminopropylsilyl group readily reacts with aldehydes and ketones. The primary amine reacts with the aldehyde to form an imine and/or other covalently bonded derivatives of the aldehyde. The imine group or other covalently bonded derivative of the aldehyde remains anchored to the modified molecular sieve and thus, the formation of such derivatives serves to effectively remove the aldehydes and ketones and their reaction products from cigarette smoke. The primary amine group also may react with hydrogen cyanide through an acid-base reaction thus reducing the levels of this compound in the cigarette smoke.

Suitable mesoporous silicate molecular sieve materials include SBA-15, MCM-41, MCM-48 and the like. These materials generally have pore sizes in the range of about 15 Δ to about 300 Δ.

Suitable reagents which may be employed to provide aminoalkylsilyl groups on the molecular sieves include aminoalkyltrialkoxy silanes such as 3-aminopropyltriethoxy silane and 3-aminopropyltrimethoxy silane. Other reagents which can be used to incorporate aminoalkylsilyl groups into the molecular sieves include alkylene polyamine derivatives such as N-[3-(trimethoxysilyl)propyl)-ethylenediamine or N'-[3-(trimethoxysilyl)propyl]-diethylenetriamine. In this case, the modified molecular sieve would contain aminoethylaminopropylsilyl or aminoethylaminoethylaminopropylsilyl groups.

The modified molecular sieve can be prepared by admixing the molecular sieve in powder or particulate form or as a slurry with the reagent such as 3-aminopropyltriethoxysilane (APS) in a solvent such as aqueous ethanol solvent. Other solvents, such as toluene, can also be used. The mixture is heated for several hours to allow the 3-aminopropyltriethoxysilane to react with and chemically bond to the molecular sieve. The reaction mixture is then decanted to obtain a reaction product. The reaction product is subsequently rinsed with a solvent, and dried in an oven at an elevated temperature such as around 100° C., or above. Although the rinsing and drying steps are optional, the drying step is preferred.

The modified molecular sieve is preferably prepared by an incipient-wetness impregnation technique conducted at elevated temperatures. The mesoporous molecular sieve is impregnated with the reagent in dry toluene via incipient-wetness impregnation at an elevated temperature.

The modified mesoporous silicate molecular sieve can be incorporated into the cigarette filter by various manufacturing techniques. In one embodiment, the modified molecular sieve is incorporated into or onto a support such as paper (e.g., tipping paper) located along a filter portion of a cigarette. As will be recognized by persons skilled in the art, such paper can be used, for example, as a wrapper or a liner in the filter portion of the cigarette. The modified molecular sieve can also be loaded onto a support such as lightly or tight folded paper inserted into a hollow portion of the cigarette filter. The support is preferably in the form of a sheet material such as crepe paper, filter paper, or tipping paper. However, other suitable support materials such as organic or inorganic cigarette compatible materials can also be used.

FIG. 1 illustrates a cigarette 2 having a tobacco rod 4, a filter portion 6, and a mouthpiece filter plug 8. As shown, the modified molecular sieve can be loaded onto folded paper 10 inserted into a hollow cavity such as the interior of a free-flow sleeve 12 forming part of the filter portion 6.

Figure 2:
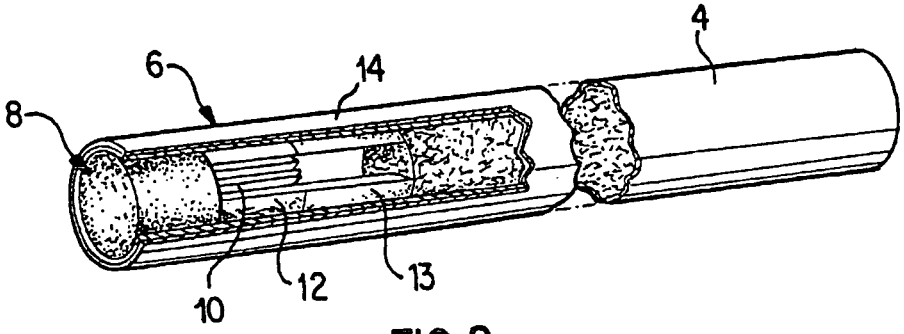
FIG. 2 is a perspective partially exploded view of another embodiment wherein a modified molecular sieve is incorporated in folded paper inserted into a hollow portion of a tubular filter element.

FIG. 2 shows a cigarette 2 having a tobacco rod 4 and a filter portion 6, wherein the folded paper 10 is located in the hollow cavity of a first free-flow sleeve 13 located between the mouthpiece filter 8 and a second free-flow sleeve 15. The paper 10 can be used in forms other than as a folded sheet. For instance, the paper 10 can be deployed as one or more individual strips, a wound roll, etc. In whichever form, the modified molecular sieve can be provided in the cigarette filter portion by a combination of the coated amount of reagent/area of the paper and/or the total area of coated paper employed in the filter, e.g., higher amounts can be provided simply by using larger pieces of coated paper. In the cigarettes shown in FIGS. 1 and 2, the tobacco rod 4 and the filter portion 6 are joined together with tipping paper 14. In both cigarettes, the filter portion 6 may be held together by filter overwrap 11.

The modified molecular sieve can be incorporated into the filter paper in a number of ways. For example, it can be mixed with water to form a slurry. The slurry can then be coated onto pre-formed filter paper and allowed to dry. The filter paper can then be incorporated into the filter portion of a cigarette in the manner shown in FIGS. 1 and 2. Alternatively, the dried paper can be wrapped into a plug shape, and inserted into a filter portion of the cigarette. For example, the paper can be wrapped into a plug shape and inserted as a plug into the interior of a free-flow filter element such as a polypropylene or cellulose acetate sleeve. In another arrangement, the paper can comprise an inner liner of such a free-flow filter element.

Alternatively and more preferably, the modified molecular sieve is added to the filter paper during the paper-making process. For example, it can be mixed with bulk cellulose to form a cellulose pulp mixture. The mixture can be then formed into filter paper according to methods known in the art.

Figure 3:
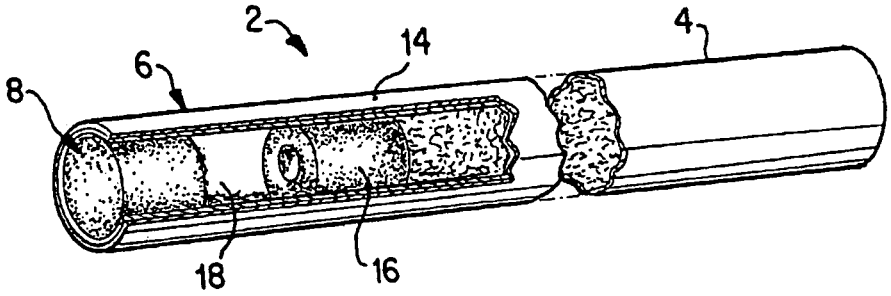
FIG. 3 is a perspective partially exploded view of another embodiment wherein a modified molecular sieve is incorporated in a plug-space-plug filter element.

In another embodiment, the modified molecular sieve is incorporated into the fibrous material of the cigarette filter portion itself. Such filter materials include, but are not limited to, fibrous filter materials including paper, cellulose, acetate fibers, and polypropylene fibers. This embodiment is illustrated in FIG. 3, which shows a cigarette 2 comprised of a tobacco rod 4 and a filter portion 6 in the form of a plug-space-plug filter having a mouthpiece filter 8, a plug 16, and a space 18. The plug 16 can comprise a tube or solid piece of material such as polypropylene or cellulose acetate fibers. The tobacco rod 4 and the filter portion 6 re joined together with tipping paper 14. The filter portion 6 may include a filter overwrap 11. The filter overwrap 11 contains traditional fibrous filter material and the modified molecular sieve can be incorporated in or on the filter overwrap 11 such as by being coated thereon. Alternatively, the modified molecular sieve can be incorporated in the mouthpiece filter 8, in the plug 16, and/or in the space 18 or can be incorporated in any element of the filter portion of a cigarette. For example, the filter portion may consist only of the mouthpiece filter 8 and the modified molecular sieve can be incorporated in the mouthpiece filter 8 and/or in the tipping paper 14.

Figure 4:
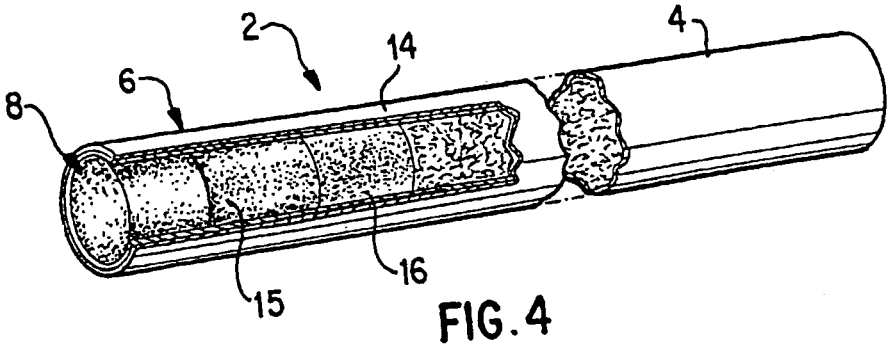
FIG. 4 is a perspective partially exploded view of another embodiment wherein a modified molecular sieve is incorporated in a three-piece filter element having three plugs.

FIG. 4 shows a cigarette 2 comprised of a tobacco rod 4 and filter portion 6. This arrangement is similar to that of FIG. 3 except the space 18 is filled with granules of the modified molecular sieve or a plug 15 made of material such as fibrous polypropylene or cellulose acetate containing a modified molecular sieve. The plug 16 can be hollow or solid and the tobacco rod 4 and the filter portion 6 joined together with tipping paper 14. There is also a filter overwrap 11.

Figure 5:
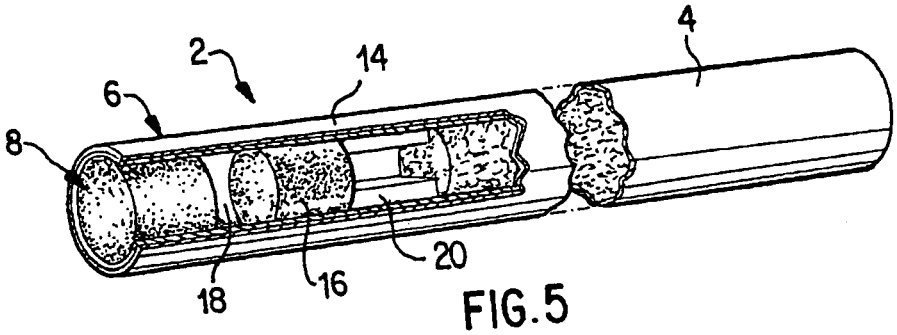
FIG. 5 is a perspective partially exploded view of another embodiment wherein a modified molecular sieve is incorporated in a four-piece filter element having a plug-space-plug arrangement and a hollow sleeve.

FIG. 5 shows a cigarette 2 comprised of a tobacco rod 4 and a filter portion 6 wherein the filter portion 6 includes a mouthpiece filter 8, a filter overwrap 11, tipping paper 14 to join the tobacco rod 4 and filter portion 6, a space 18, a plug 16, and a hollow sleeve 20. The modified molecular sieve can be incorporated into one or more elements of the filter portion 6. For instance, it can be incorporated into the sleeve 20 or granules can be filled into the space within the sleeve 20. If desired, the plug 16 and sleeve 20 can be made of material such as fibrous polypropylene or cellulose acetate containing the modified molecular sieve. As in the previous embodiment, the plug 16 can be hollow or solid.

Figure 6:
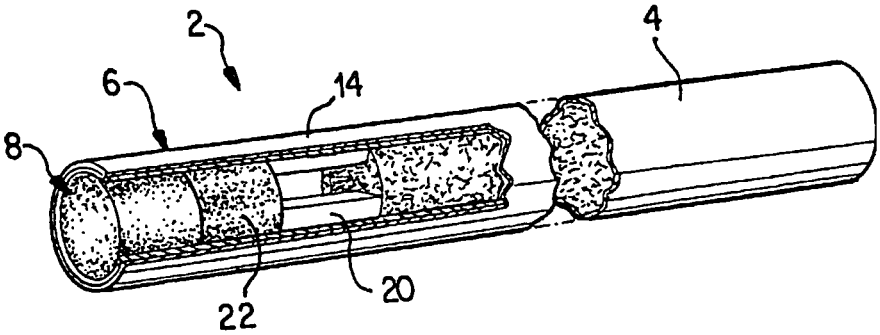
FIG. 6 is a perspective partially exploded view of another embodiment wherein a modified molecular sieve is incorporated in a three-part filter element having two plugs and a hollow sleeve.
Figure 7:
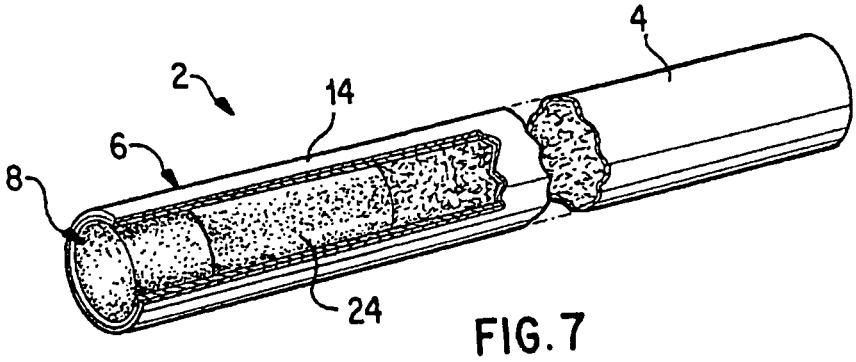
FIG. 7 is a perspective partially exploded view of another embodiment wherein a modified molecular sieve is incorporated in a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, and the modified molecular sieve can be incorporated in one or more of these filter elements. In FIG. 7, the filter portion 6 includes a mouthpiece filter 8 and a plug 24, and the modified molecular sieve can be incorporated in one or more of these filter elements. Like the plug 16, the plugs 22 and 24 can be solid or hollow. In the cigarettes shown in FIGS. 6 and 7, the tobacco rod 4 and filter portion 6 are joined together by tipping paper 14.

Various techniques can be used to apply the modified molecular sieve to filter fibers or other substrate supports. For example, the modified molecular sieve can be added to the filter fibers before they are formed into a filter cartridge, e.g., a tip for a cigarette, or added to the filter fibers, for example, in the form of a dry powder or a slurry by methods known in the art. If applied in the form of a slurry, the fibers are allowed to dry before they are formed into a filter cartridge.

In another embodiment, the modified molecular sieve is employed in a hollow portion of a cigarette filter. For example, some cigarette filters have a plug/space/plug configuration in which the plugs comprise a fibrous filter material and the space is simply a void between the two filter plugs. That void can be filled with the modified molecular sieve. An example of this embodiment is shown in FIG. 3. The modified molecular sieve can be in granular form or can be loaded onto a suitable support such as a fiber or thread.

Figure 8:
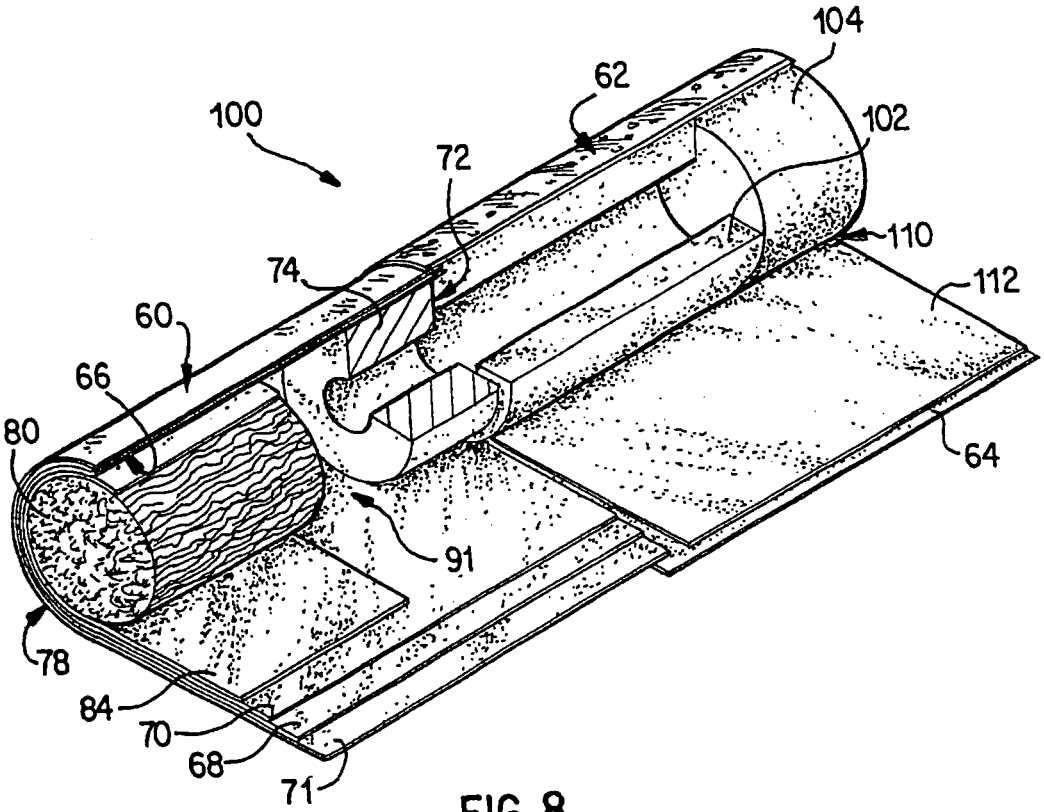
FIG. 8 is a perspective partially exploded view of another embodiment wherein a modified molecular sieve is incorporated in a filter element of a cigarette used with an electrical smoking device.

In another embodiment, the modified molecular sieve may be employed in a filter portion of a cigarette for use with a smoking device as described in U.S. Pat. No. 5,692,525, the entire content of which is hereby incorporated by reference. FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 are wrapped about cylindrical tobacco plug 80. Various modifications can be made to a filter arrangement for such a cigarette incorporating the modified molecular sieve.

In such a cigarette, the modified molecular sieve can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, the modified molecular sieve can be incorporated into the fibrous wall portions of the tubular free-flow filter element 102 itself. For instance, the tubular free-flow filter element or sleeve 102 can be made of suitable materials such as polypropylene or cellulose acetate fibers and the modified molecular sieve can be mixed with such fibers prior to or as part of the sleeve forming process.

In another embodiment, the modified molecular sieve can be incorporated into the mouthpiece filter plug 104 instead of in the element 102. However, as in previously described embodiments, the modified molecular sieve may be incorporated into more than one component of a filter portion such as by being incorporated into the mouthpiece filter plug 104 and into the tubular free-flow filter element 102.

The filter portion 62 of FIG. 8 can also be modified to created a void space into which the modified molecular sieve can be inserted.

The amount of modified molecular sieve which can be employed in the cigarette filter by way of incorporation on a suitable support such as filter paper and/or filter fibers, depends on the amount of selected substituents such as aldehydes in the tobacco smoke and the amount of aldehydes desired to be removed. As an example, the filter paper and the filter fibers may contain from 10% to 50% by weight of the modified molecular sieve.

EXAMPLE

Mesoporous SBA-15 was modified with aminopropyl functional groups via incipient-wetness impregnation with (3-aminopropyl)triethoxysilane (0.017-0.267μ) at 100EC in dry toluene.

Characterization by powder x-ray diffraction (XRD), transmission electron microscopy (TEM), $N_2$ adsorption, thermogravimetric analysis (TGA), Fourier-transform infrared (FTIR), electron energy loss (EELS), and 1H, 13C, and 29Si magnetic-angle-spinning (MAS) NMR spectroscopy with or without 1H cross polarization (CP) was carried out to investigate the pore structure of the modified material and the chemical nature and thermal stability of incorporated organic moieties. The results revealed that the channels of the SBA-15 material are essentially lined with abundant silanol groups, which serve as the sites for the incorporation of aminopropyl groups. The loading of the aminopropyl groups by impregnation is quantitatively controllable and reaches a maximum molar percentage of about 11% with respect to silicon, which indicates a percentage of the silicon present as silanol groups. The incorporated aminopropyl groups are chemically bonded to surface silicon associated with the silanol groups of the SBA-15 material and thermally stable up to 550° C. The modified materials still possess high surface area and defined mesoporous structure with decreased pore dimensions due to occupation of the incorporated aminopropyl groups. This indicates a uniform distribution of aminopropyl groups on the internal surface of the SBA-15 material.

This Example shows that aminoalkyl functional groups can be successfully incorporated into the channels of mesoporous silicate molecular sieves by a more efficient incipient-wetness impregnation technique while preserving the well-defined mesoporous structure of the parent molecular sieve.

While the invention has been described with reference to preferred embodiments, it is to be understood that variations and modifications may be resorted to as will be apparent to those skilled in the art. Such variations and modifications are to be considered within the purview and scope of the present invention.

What is claimed is:

1. A cigarette filter comprising a mesoporous silicate molecular sieve modified with an aminoalkylsilyl group.

2. The cigarette filter of claim 1, wherein the molecular sieve is SBA-15, MCM-41 or MCM-48.

3. The cigarette filter of claim 1, wherein the aminoalkylsilyl group is an aminopropylsilyl group.

4. The cigarette filter of claim 3, wherein the aminopropylsilyl group is selected from the group consisting of 3-aminopropylsilyl, aminoethylaminopropylsilyl and aminoethylaminoethyl aminopropylsilyl.

5. The cigarette filter of claim 4, wherein the aminopropylsilyl group comprises 3-aminopropylsilyl.

6. A cigarette filter according to claim 1, wherein the modified molecular sieve is prepared by reacting said molecular sieve with an aminoalkyltrialkoxy silane reagent.

7. A cigarette filter according to claim 6, wherein the molecular sieve comprises SBA-15 and the reagent is 3-aminopropyltriethoxy silane.

8. A cigarette filter according to claim 1, wherein the modified molecular sieve is prepared by reacting said molecular sieve with N-[3-(trimethoxysilyl)propyl]-ethylenediamine or N'[3-trimethoxysilyl)propyl]-diethylenetriamine.

9. The cigarette filter of claim 1, wherein the filter is attached to a tobacco rod.

10. The cigarette filter of claim 1, wherein the modified molecular sieve is incorporated into at least one cigarette filter component selected from filter paper, a shaped paper insert, a plug, a space or a free-flow sleeve.

11. The cigarette filter according to claim 1, wherein said modified molecular sieve is incorporated in cigarette filter paper located within a free-flow filter, the filter paper optionally having a three-dimensional shape and/or the filter paper being a liner on the interior of a hollow tubular element.

12. The cigarette filter according to claim 1, wherein said modified molecular sieve is incorporated with cellulose acetate fibers and/or polypropylene fibers forming a plug or a free-flow filter element.

13. The cigarette filter according to claim 1, wherein said modified molecular sieve is incorporated in a cavity or is incorporated in at least one of a mouthpiece filter plug and a tubular filter element adjacent to said mouthpiece filter plug or is incorporated in at least one of a mouthpiece filter plug, a first tubular filter element adjacent to said mouthpiece filter plug, and a second tubular filter element adjacent to the first tubular element or is incorporated in at least one part of a three-piece filter including a mouthpiece filter plug, a first filter plug adjacent to said mouthpiece filter plug, and a second filter plug adjacent to the first filter plug.

14. The cigarette filter of claim 1, wherein (i) the molecular sieve is MCM-41, or (ii) the aminopropylsilyl group is an aminoethylaminopropylsilyl or aminoethylaminoethyl aminopropylsilyl group.

15. A method of manufacturing a cigarette filter comprising:

incorporating a mesoporous silicate molecular sieve modified with an aminoalkylsilyl group into a cigarette filter.

16. The method according to claim 15, further comprising attaching the cigarette filter to a tobacco rod.

17. The method according to claim 16, wherein the modified molecular sieve is incorporated into at least one cigarette filter component selected from filter paper, tipping paper, a shaped paper insert, a plug, a space or a free-flow sleeve.

18. The method according to claim 16, further comprising a step of attaching filter paper within a free-flow filter of a cigarette by forming said filter paper into a three-dimensional shape or attaching said filter paper as a liner on the interior of a hollow tubular element or combining said modified molecular sieve with fibers and forming a filter element from said reagent and fibers or combining said modified molecular sieve with cellulose and/or polypropylene fibers and forming a plug or free-flow filter element or incorporating said modified molecular sieve in a cavity of said filter.

19. The method according to claim 16, further comprising incorporating said modified molecular sieve in at least one of a mouthpiece filter plug and a tubular filter element adjacent to said mouthpiece filter plug or incorporating said modified molecular sieve in at least one of a mouthpiece filter plug, a first tubular filter element adjacent to said mouthpiece filter plug, and a second tubular filter element adjacent to the first tubular element or incorporating said modified molecular sieve in at least one part of a three-piece filter including a mouthpiece filter plug, a first filter plug adjacent to said mouthpiece filter plug, and a second filter plug adjacent to the first filter plug.

20. The method according to claim 15, wherein the molecular sieve is SBA-15, MCM-41 or MCM-48.

21. The method according to claim 15, wherein the aminoalkylsilyl group is an aminopropylsilyl group.

22. The method according to claim 21, wherein the aminopropylsilyl group is selected from the group consisting of 3-aminopropylsilyl, aminoethylaminopropylsilyl and aminoethylaminoethyl aminopropylsilyl.

23. The method according to claim 22, wherein the aminopropylsilyl group comprises 3-aminopropylsilyl.

24. The method according to claim 15, wherein the modified molecular sieve is prepared by reacting said molecular sieve with an aminoalkyltrialkoxy silane reagent.

25. The method according to claim 24, wherein the molecular sieve comprises SBA-15 and the reagent is 3-aminopropyltriethoxy silane.

26. The method according to claim 15, wherein the modified molecular sieve is prepared by reacting said molecular sieve with N-[3-(trimethoxysilyl)propyl]-ethylenediamine or N'-[3-trimethoxysilyl)propyl]-diethylenetriamine.

27. The method according to claim 15, wherein the modified molecular sieve is incorporated with cellulose acetate fibers and/or polypropylene fibers forming a plug or a free-flow filter element.

28. A method of smoking a filter cigarette which comprises lighting the cigarette to form tobacco smoke and drawing the smoke through the filter, wherein the filter comprises a mesoporous silicate molecular sieve modified with an aminoalkylsilyl group and the modified molecular sieve reacts with at least one constituent of the smoke to remove or reduce the concentration of said at least one constituent.

29. The method according to claim 28, wherein the filter is attached to a tobacco rod.

30. The method according to claim 28, wherein said modified molecular sieve is incorporated with cellulose acetate fibers and/or polypropylene fibers forming a plug of a free-flow filter element.

31. The method according to claim 29, wherein the modified molecular sieve is incorporated into at least one cigarette filter component selected from filter paper, tipping paper, a shaped paper insert, a plug, a space or a free-flow sleeve.

32. The method according to claim 29, wherein said modified molecular sieve is incorporated in a cavity or is incorporated in at least one of a mouthpiece filter plug and a tubular filter element adjacent to said mouthpiece filter plug or is incorporated in at least one of a mouthpiece filter plug, a first tubular filter element adjacent to said mouthpiece filter plug, and a second tubular filter element adjacent to the first tubular element or is incorporated in at least one part of a three-piece filter including a mouthpiece filter plug, a first filter plug adjacent to said mouthpiece filter plug, and a second filter plug adjacent to the first filter plug.

33. The method according to claim 32, wherein the modified molecular sieve is located in a filter paper within a free-flow filter of a cigarette by forming said filter paper into a three-dimensional shape or attaching said filter paper as a liner on the interior of a hollow tubular element or combining said modified molecular sieve with fibers and forming a filter element from said reagent and fibers or combining said modified molecular sieve with cellulose and/or polypropylene fibers and forming a plug or free-flow filter element or incorporating said modified molecular sieve in a cavity of said filter.

34. The method according to claim 29, wherein said modified molecular sieve is in at least one of a mouthpiece filter plug and a tubular filter element adjacent to said mouthpiece filter plug or incorporating said modified molecular sieve in at least one of a mouthpiece filter plug, a first tubular filter element adjacent to said mouthpiece filter plug, and a second tubular filter element adjacent to the first tubular element or incorporating said modified molecular sieve in at least one part of a three-piece filter including a mouthpiece filter plug, a first filter plug adjacent to said mouthpiece filter plug, and a second filter plug adjacent to the first filter plug.

35. The method according to claim 28, wherein the molecular sieve is selected from SBA-15, MCM-41 or MCM-48.

36. The method according to claim 28, wherein the aminoalkylsilyl group is an aminopropylsilyl group.

37. The method according to claim 36, wherein the aminopropylsilyl group is selected from the group consisting of 3-aminopropylsilyl, aminoethylaminopropylsilyl and aminoethylaminoethyl aminopropylsilyl.

38. The method according to claim 37, wherein the aminopropylsilyl group comprises 3-aminopropylsilyl.

39. The method according to claim 28, wherein the modified molecular sieve is prepared by reacting said molecular sieve with an aminoalkyltrialkoxy silane.

40. The method according to claim 39, wherein the molecular sieve comprises SBA-15 and the reagent comprises 3-aminopropyltriethoxy silane.

41. The method according to claim 28, wherein the modified molecular sieve is prepared by reacting said molecular sieve with N-[3-(trimethoxysilyl)propyl]-ethylenediamine or N'-[3-trimethoxysilyl)propyl]-diethylenetriamine.

42. The method according to claim 28, wherein the said at least one constituent of tobacco smoke comprises an aldehyde.

* * * * *